US009375091B1

(12) United States Patent
Baker

(10) Patent No.: US 9,375,091 B1
(45) Date of Patent: Jun. 28, 2016

(54) PORTABLE ADJUSTABLE HEADREST

(71) Applicant: Scott E. Baker, Evansville, IN (US)

(72) Inventor: Scott E. Baker, Evansville, IN (US)

( * ) Notice: Subject to any disclaimer, the term of this patent is extended or adjusted under 35 U.S.C. 154(b) by 0 days.

(21) Appl. No.: 14/625,666

(22) Filed: Feb. 19, 2015

(51) Int. Cl.
*A47C 7/38* (2006.01)

(52) U.S. Cl.
CPC ..... *A47C 7/383* (2013.01)

(58) Field of Classification Search
CPC ..... A47C 7/36; A47C 7/38; A47C 7/383
USPC ..... 297/220, 397, 399, 400, 401, 402, 410
See application file for complete search history.

(56) References Cited

U.S. PATENT DOCUMENTS 247,208 A * 9/1881 Miller ..... A47C 7/383 297/410 X
283,533 A * 8/1883 Taylor ..... B60N 2/4879 297/401
332,154 A * 12/1885 Jewett ..... B60N 2/4879 297/401
366,080 A * 7/1887 Doubleday ..... B60N 2/4879 297/401 X
1,565,514 A * 12/1925 Schumacher ..... A47C 7/383 297/399
2,492,383 A * 12/1949 Jones ..... A61B 19/203 297/402 X
2,527,544 A * 10/1950 Goodwin ..... A47C 7/383 297/397
2,613,731 A * 10/1952 Roginski ..... A47C 7/383 297/399
2,634,798 A * 4/1953 Taylor ..... B60N 2/4879 297/401
2,897,878 A * 8/1959 Mungovan ..... A47C 7/38 297/399 X
D201,961 S * 8/1965 Lohn ..... 297/397
3,205,005 A * 9/1965 Brown ..... B60N 2/4879 297/397 X
3,226,159 A * 12/1965 Binding ..... B60N 2/4879 297/397
3,328,082 A * 6/1967 Knud ..... B60N 2/4844 297/397
3,328,083 A * 6/1967 Bourne ..... A47C 7/38 297/397
3,369,786 A * 2/1968 Schloemer ..... B60N 2/4879 297/397 X
3,387,886 A * 6/1968 Longo ..... B60N 2/4879 297/397
3,497,259 A * 2/1970 Sherfey ..... A61G 5/12 297/391
3,730,589 A * 5/1973 Lane ..... A61G 5/12 297/410 X
3,865,450 A * 2/1975 Bruenig ..... B60N 2/4802 297/397
4,030,781 A * 6/1977 Howard ..... A47C 7/383 297/397
4,116,148 A * 9/1978 Torrez ..... A47C 27/14 297/382 X
4,190,289 A * 2/1980 Brunig ..... B60N 2/48 297/391 X (Continued)

*Primary Examiner* — Rodney B White
(74) *Attorney, Agent, or Firm* — Gary K. Price

(57) ABSTRACT

A portable adjustable headrest that is releasably secured to the seatback of a casual seating. The headrest generally includes a headrest support bar, and a pair of rosettes that attach to a pair of vertical arms of the headrest support bar for vertical adjustment. First and second clamp bars having telescoping extensions for receipt in channels defined in each of the rosettes. Each clamp bar further includes a hook member opposite the telescoping extension, that define a slot for receipt of the chair's seatback frame. The clamp bars can each be selectively positioned in order to horizontally adjust the width of the headrest such that the clamp bars, as a whole is extensible and retractable to suit the needs of both wider designed chairs and more narrowly designed chairs. A cushioned member having a pocket sized for receiving an upper portion of the support bar, and further including an exterior surface and interior foam layer.

16 Claims, 9 Drawing Sheets

(56) References Cited

U.S. PATENT DOCUMENTS 5,074,574 A * 12/1991 Carwin ..... A61G 5/12 297/397 X
5,897,167 A * 4/1999 Keith ..... A47C 7/383 297/397
5,927,814 A * 7/1999 Yoshimura ..... B60N 2/48 297/220
5,967,613 A * 10/1999 McKeever ..... A61G 5/12 297/397
6,010,192 A * 1/2000 King ..... A47C 7/383 297/397 X
6,460,927 B1 * 10/2002 Groth ..... A61G 5/12 297/410 X
7,204,557 B1 * 4/2007 Burton ..... A47C 7/383 297/397
7,207,630 B1 * 4/2007 Reynolds ..... A61G 5/12 297/397 X
7,303,237 B1 * 12/2007 Hughes ..... B60N 2/4879 297/220 X
7,980,580 B2 * 7/2011 Loewenthal ..... A61G 5/12 248/230.1
8,517,469 B1 * 8/2013 Hetzel ..... A61G 5/1067 280/250.1
8,979,196 B2 * 3/2015 Simpson ..... A61G 5/10 297/397 X
2007/0108829 A1 * 5/2007 Lehn ..... A61G 5/10 297/397
2011/0260519 A1 * 10/2011 Carrigan, Sr. ..... A61G 5/12 297/397
2012/0200133 A1 * 8/2012 Simpson ..... A61G 5/10 297/397

* cited by examiner

PORTABLE ADJUSTABLE HEADREST

CROSS REFERENCES TO RELATED APPLICATIONS

U.S. Provisional Application for Patent No. 61/941,744, filed Feb. 19, 2014, with title "Portable Adjustable Headrest" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The present invention relates generally to furnishings, seating, and accessories therefor, and more particularly to various embodiments of a removable, portable headrest which may be temporarily installed upon the back of a casual seating, such as a folding lawn chair, deck chair, and the like, for the support of a seated person's head. The device may be removed for storage or placement on another chair, as desired. The present removable headrest is particularly well suited for use with lawn chairs, deck chairs, and the like, but may be adapted for use with other types of chairs.

2. Brief Description of Prior Art

Lightweight, portable, and/or casual seating, such as folding lawn chairs, deck chairs, and the like, have been known for some time. One feature which is almost universal with such seating is the lack of any head support since this type of seating needing to be relatively simple, lightweight, and to fold to a compact size.

Accordingly, such seating generally provides only the bare minimum of comfort or convenience features, with no real attempt at padding or upholstery (other than perhaps some form of webbing), and often not even having arm rests, in the case of most folding metal chairs.

Accordingly, a need will be seen for a removable, portable headrest for chairs such as lawn chairs, deck chairs, folding chairs and other lightweight and portable seating. While the present headrest is adapted to be particularly suitable for such seating, it should be noted that it is also applicable to other types of seating as well.

As will be seen from the subsequent description, the preferred embodiments of the present invention overcome the advantages of the prior art. In this regard, the present invention discloses a portable, adjustable headrest for releasable attachment to preferably lawn chairs, deck chairs, folding chairs, and other lightweight and portable seating.

SUMMARY OF THE INVENTION

A portable adjustable headrest that is releasably secured to the seatback of a casual seating, such as a folding lawn chair, a deck chair, and the like. The headrest includes a headrest support bar, first and second rosettes that slidingly receive vertical arms of the headrest support bar for vertical adjustment. The headrest further includes first and second clamp bars having telescoping extensions for receipt in channels defined in each of the rosettes. Each clamp bar further includes a hook member opposite the telescoping extensions, that defines a slot for receipt of the chair's seatback frame. The clamp bars can each be selectively positioned within the channel of the rosettes in order to adjust the width of the headrest such that the clamp bars, as a whole is extensible and retractable to suit the needs of both wider designed chairs and more narrowly designed chairs. Once the width of the headrest is positioned with respect to the seatback frame as described, the headrest support bar is vertically positioned by sliding the vertical arms either in an upwardly or downwardly direction until the upper portion of the support bar is properly positioned.

The headrest further includes a cushioned member having a configuration similar to the upper portion of the headrest support bar. The cushion member including a pocket sized for receiving the upper portion of the support bar, and further including an exterior surface and interior foam layer.

DESCRIPTION OF THE PREFERRED EMBODIMENT

The device of the present invention is directed to a portable adjustable headrest that is used with lightweight, portable and/or casual seating, such as folding lawn chairs, deck chairs and the like. Specifically, it will be noted in the following description that the portable adjustable headrest of the present invention discloses a device which is adapted by its size, shape and flexibility, for engagement with a top portion of a seatback such as lawn chairs, deck chairs, folding chairs and other lightweight and portable seating. In the broadest context, the portable adjustable headrest as disclosed consists of components configured and correlated with respect to each other so as to attain the desired objective.

The present invention is now exemplified by a particular embodiment which is illustrated in the accompanying drawings.

Figure 1:
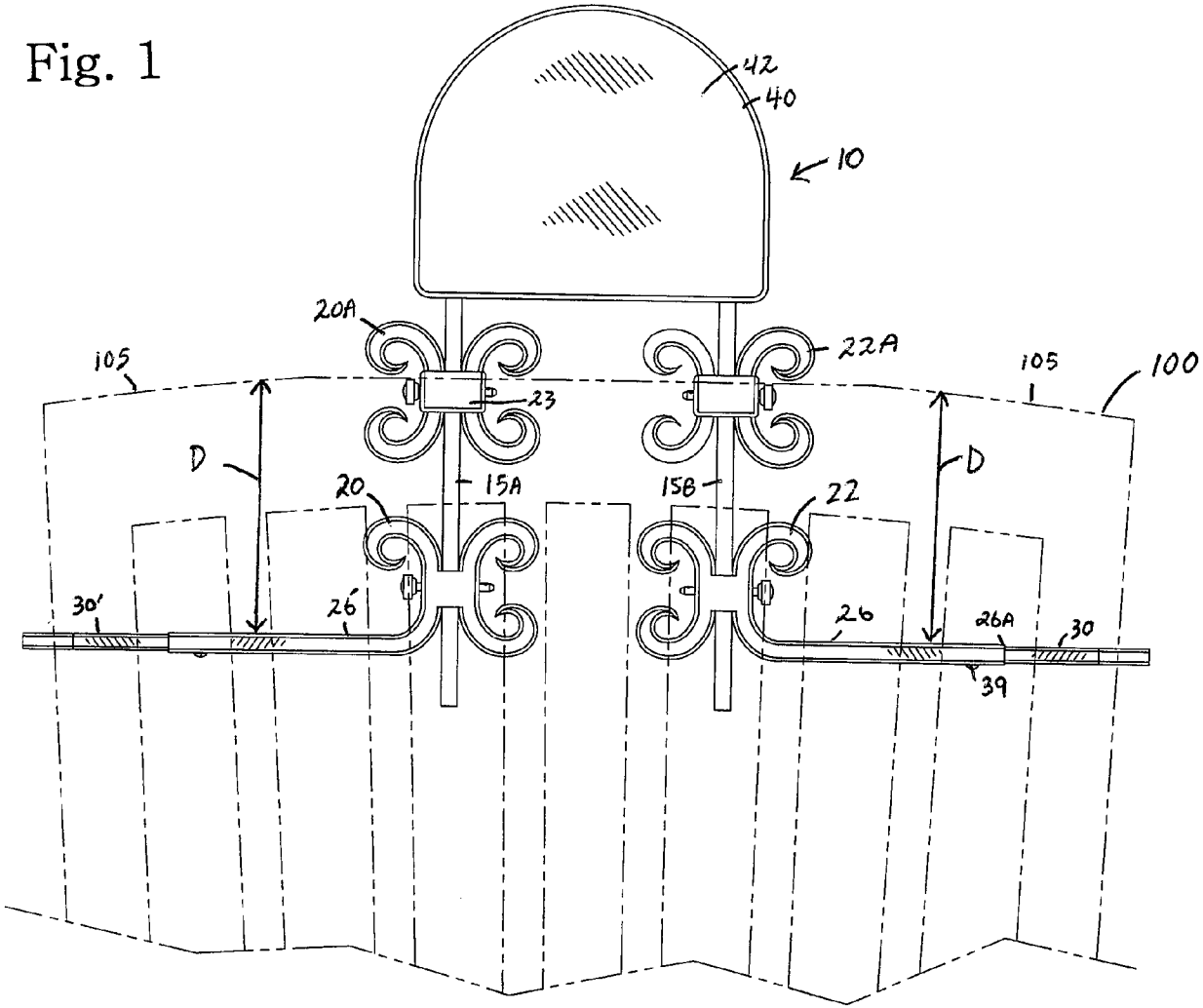
FIG. 1 is a front view of the present invention, a portable adjustable headrest attached to a prior art lawn chair shown in broken lines.

Referring to the drawings, FIG. 1 shows a portable adjustable headrest 10 that is releasably secured to the seatback of a lawn chair 100. The headrest 10 includes a headrest support bar 15, with first and second lower rosettes 20, 22, and preferably includes first and second upper rosettes respectively 20A, 22A. In the preferred embodiment, the rosettes releasably attach to vertical arms 15A, 15B of the support bar 15.

Each rosette 20, 22, and 20A, 22A, define a clamp member 18 having a horizontal bore 25 and openings 25A on each side of the clamp member 18. The clamp member 18 for, as will be described, selectively securing each upper and lower rosette along the length of the vertical arms 15A, 15B. Each horizontal bore 25 is sized for receiving a pin member 27 having a body portion 27A and can include a threaded end, with a cooperating fastener 27B. As will be understood, tightening the pin member 27 and fastener 27B secures the rosette to the vertical arm.

Figure 8:
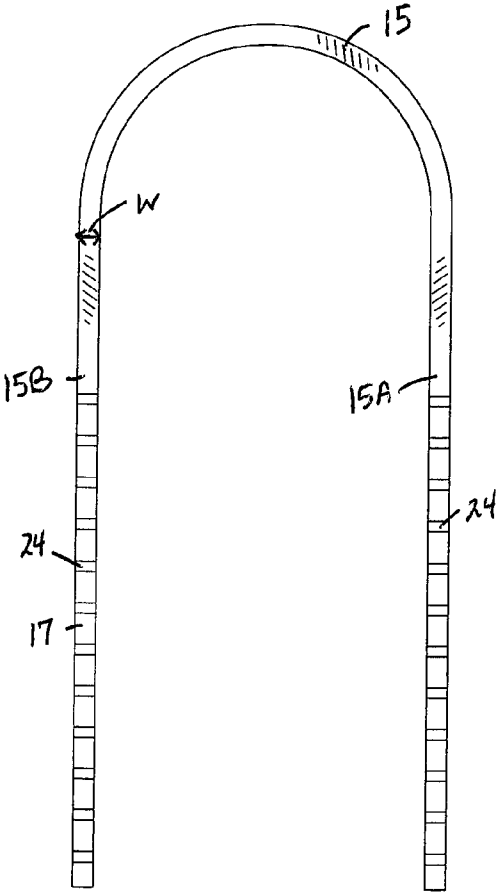
FIG. 8 is a rear view of the present invention's headrest support bar.
Figure 11:
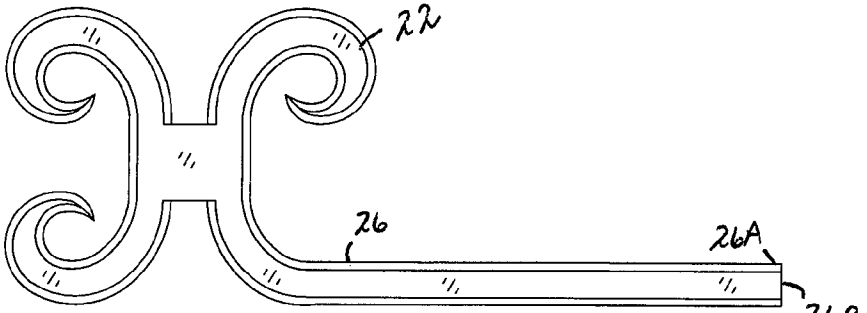
FIG. 11 is a front view of the present invention's lower right side rosette.
Figure 12:
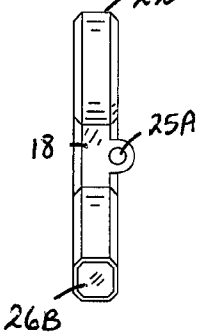
FIG. 12 is an outside, side view of the present invention's lower right side rosette.
Figure 13:
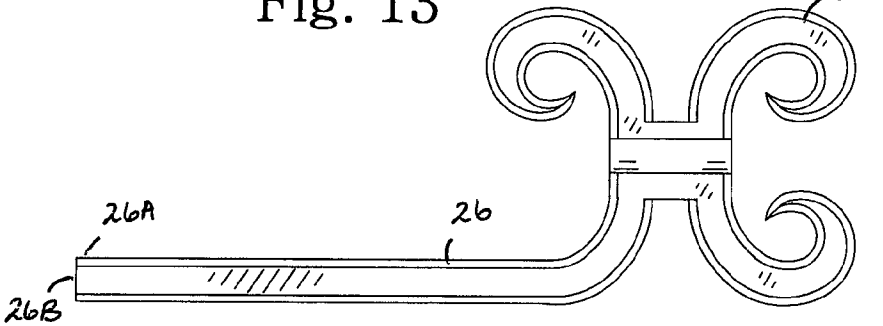
FIG. 13 is a rear view of the present invention's lower right side rosette.
Figure 14:
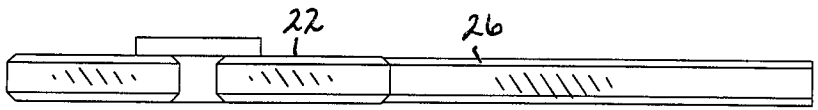
FIG. 14 is a rear, top view of the present invention's lower right side rosette.
Figure 15:
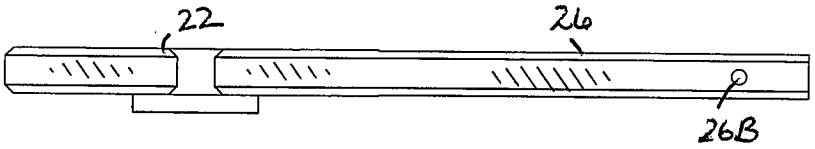
FIG. 15 is a rear, bottom view of the present invention's lower right side rosette.
Figure 16:
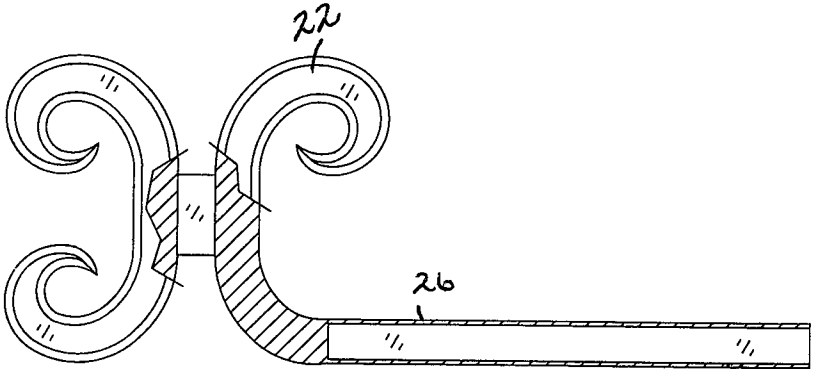
FIG. 16 is a front, sectional view of the present invention's lower right side rosette.
Figure 18:
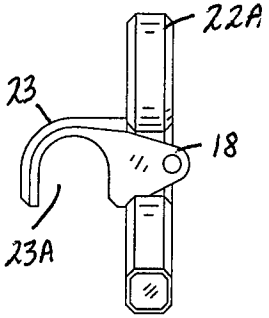
FIG. 18 is a side view of an upper rosette.
Figure 20:
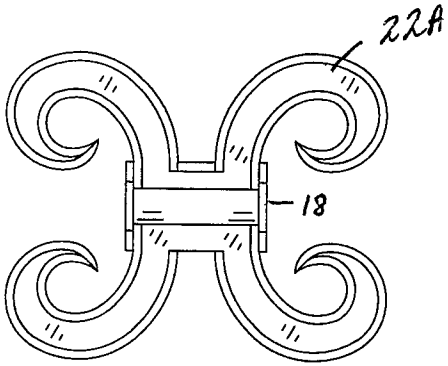
FIG. 20 is a rear view of an upper rosette.
Figure 17:
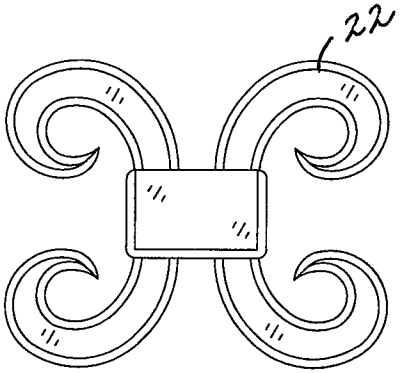
FIG. 17 is a front view of the lower right side rosette.
Figure 19:
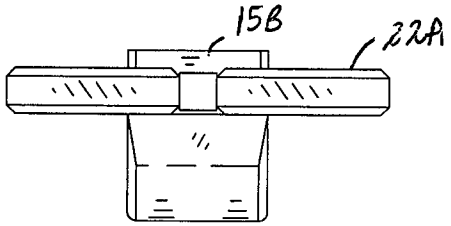
FIG. 19 is a top view of an upper rosette.
Figure 21:
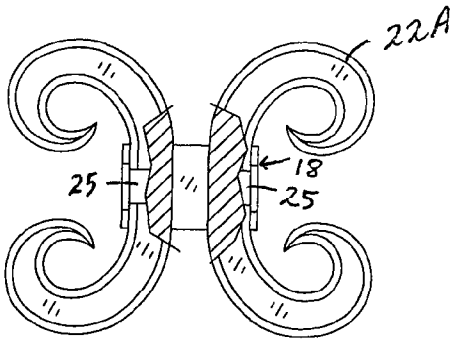
FIG. 21 is a rear view of an upper rosette.
Figure 22:
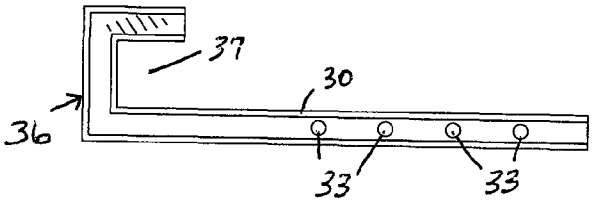
FIG. 22 is a bottom view of the present invention's lower left clamp arm.
Figure 23:
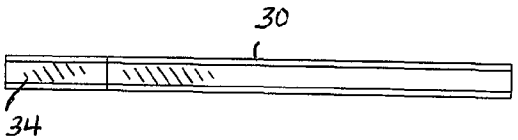
FIG. 23 is a front view of the present invention's lower left clamp arm.

As illustrated, the rear side 17 of the vertical arms 15A, 15B include a plurality of horizontal furrows 24 disposed along the length of the vertical arms 15A, 15B. As best shown in FIG. 8, each furrow 24 extends the width "W" of the rear side 17 of the vertical arm.

Each furrow 24 is sized for receiving a portion of the length of the body 27A of the pin member 27 when securing the clamp member 18 of the rosette to the vertical arm. More particularly, the furrow 24 aligns with the horizontal bore 25 of the rosette such that when the user inserts the pin member 27 through the horizontal bore 25 of the rosette, a portion of the body 27A of the pin member 27 is received in the horizontal furrow 24. Tightening the pin member 27 with fastener 27B secures the rosette to the vertical arm, securing the pin member 27 within both the horizontal bore 25 and the horizontal furrow 24.

As illustrated, the support bar 15 generally includes a first side, referenced as horizontal arm 15A, and a second side, referenced as horizontal arm 15B. As will be understood, the two sides are symmetrically constructed with pairs of elements on each side of the support bar 15. The embodiments of the first side 15A being identical to the second side 15B. As such, only the second side 15B may at times be shown and described.

Similarly, each of the rosettes are identically constructed except that the lower rosettes 20, 22, as will be described, further include extension portions and telescoping extension ends with clamp bars for attaching to the chair 100. As such, only the elements (rosettes) on the second side 15B may be described, it being understood that the other set of elements for side 15A are identical with the further exception that the elements for side 15A are mirror images of the second side of elements being described.

The lower rosettes 20, 22 each include a horizontal extension portion, designated as 26, 26'. The extension portion 26 has a distal end 26A and aperture 26B. As illustrated, the extension portion 26 horizontally extends in a first direction, and the extension portion 26' horizontally extends in a second, opposite direction. The extension 26 further defines a channel 26C sized and shaped for engaging a telescoping extension end 34 of a clamp bar 30. The extension end 34 including a plurality of adjustment locking holes 33 that in application, align with the aperture 26B of the rosettes.

Figure 3:
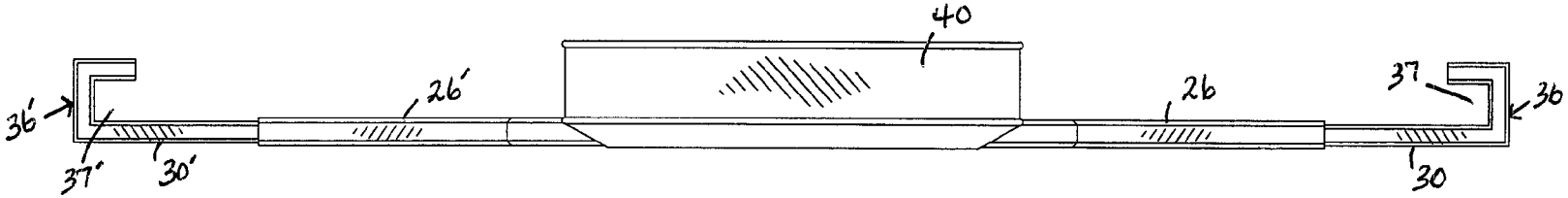
FIG. 3 is a top view of the present invention.
Figure 4:
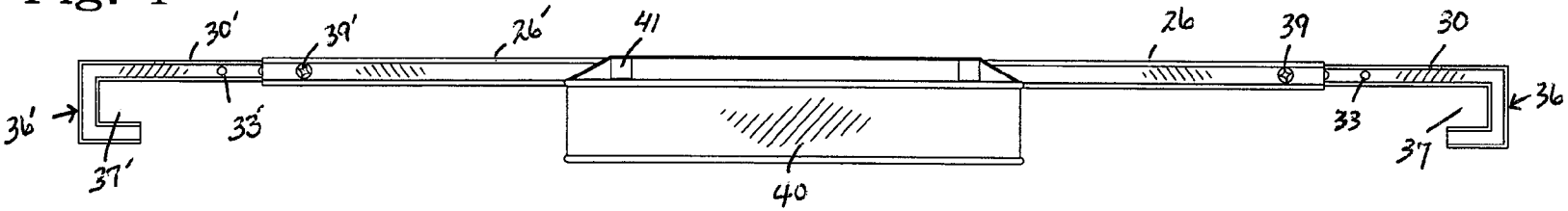
FIG. 4 is a bottom view of the present invention.
Figure 7:
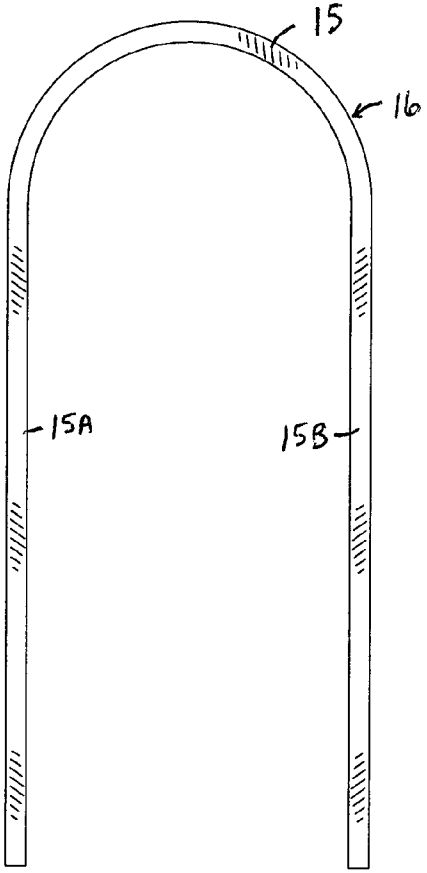
FIG. 7 is a front view of the present invention's headrest support bar.
Figure 6:
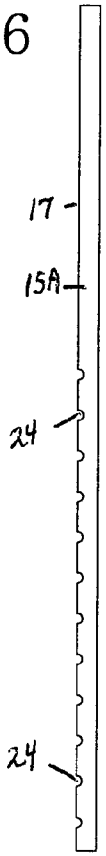
FIG. 6 is a side view of the present invention's headrest support bar.
Figure 5:
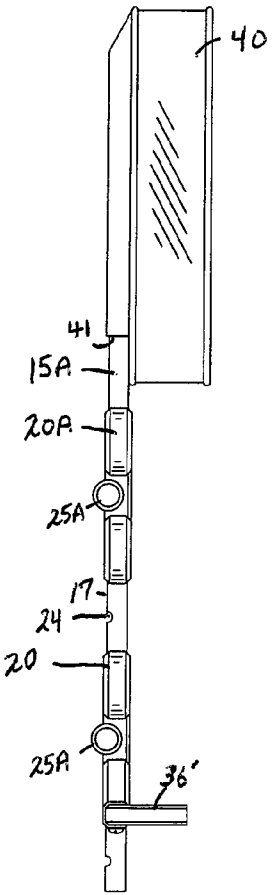
FIG. 5 is a side view of the present invention.
Figure 9:
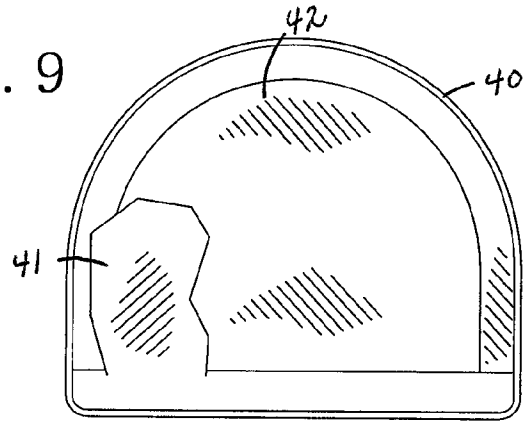
FIG. 9 is a rear view of the present invention's pillow.
Figure 10:
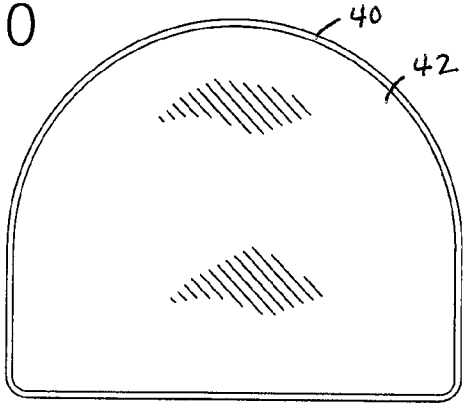
FIG. 10 is a front view of the present invention's pillow.

As illustrated, the clamp bar 30 further includes a hook member 36 opposite the extension end 34. The hook member 36 defining a slot 37 for, as will be understood, receipt of the seatback frame (not shown). As should be further understood, the slot 37 releasably receives the seatback frame without fastening. Each lower side rosette includes the slot ends 37, 37' (see FIGS. 3 and 4), that are spaced apart to clamp onto the chair 100. It is this clamping action that assists the clamping bars 30, 30' to secure itself to opposite sides of the chair and yet be easily released from the chair when desired.

As illustrated, the upper end of the headrest support bar 15 has a U-shaped configuration, and includes at least one vertical arm. In the preferred embodiment, and as illustrated, the support bar 15 includes the vertical arms 15A, 15B, that the lower rosettes 20, 22 attach to. The lower rosettes 20, 22, each include the clamp bars 30, 30', with the defined hook member ends 36, 36' are unique in being able to adjustably friction-fit to headrest 10 to the seatback frame without fastening. However, it is within the ambit of the present invention that fasteners such as screws can be utilized.

The clamp bar 30 can each be selectively positioned within the channel 26C of the extension 26 in order to adjust the width of the headrest 10 such that the ends 36, 36' not only receive the seatback frame, but also result in a friction-fit therein. Once positioned, aligning one of the locking holes 33 with the aperture 26B and securing with a pin 39 maintains position of the clamp bar 30 within the extension 26. Of necessity, the clamp bars 30, 30' are formed so as to grip the chair frame compressively so that it is not easily dislodged. Both engineering plastics and metals are able to accomplish this as would be known to those of skill in the art.

Preferably, the telescoping extension end 34 of the clamp bar 30 is a collinear frictionally engaged extension 34 such that the clamp bar 30 as a whole is extensible and retractable to suit the needs of both wider designed chairs and more narrowly designed chairs where moving the clamp bar 30 within the channel 26C of extension 26.

The locking holes 33 are preferably threaded passages or inserts, and pin 39, a cooperatingly threaded bolt.

The Inventor has found a preferred distance "D" (see FIG. 1) of between about 8 inches to about 21 inches, preferably about 8¼ inches, between the top 105 of the chair 100 and the horizontal extension 26 and clamp bar 30. This distance D assures additional support during application. In use, as the user rests his/her head on the upper portion 16 of the support bar 15. A pressure is therefore placed on the upper portion 16 in a first direction (in a direction away from the user's head), causing the lower portion of the headrest to react in an opposite direction (into the user's back area). With the extensions and clamp bar disposed at a distance D as discussed, the user will maintain the headrest 10 in position. In particular, when the user is seated in the chair, the user's upper back will rest in contact with the lower rosettes and horizontal extensions such that the lower portion is supported in place by the user's upper back thereby preventing the lower portion from moving in the opposite direction and thereby further preventing the upper portion 16 from moving in the first direction.

In application, the lower rosettes 20, 22 should first be releasably attached to the support bar 15 so that the components of the present invention are together but not yet tightened. The extensions are positioned the distance D, and the width of the headrest is positioned so that the slots 37, 37' on each end of the headrest 10 frictionally receive the seatback frame as discussed.

Once the distance D of the headrest is positioned, and the width of the headrest 10 is positioned with respect to the seatback frame as described, the headrest support bar 15 can be vertically positioned such that the vertical portion 16 of the support bar 15 is properly positioned.

Rather than having two (2) horizontal extensions 26, 26', each having telescoping extensions and opposite slots 37, 37' as described, in the alternative, a single horizontal extension (not shown) with a telescoping extension and opposite slots could be used. The telescoping extension for adjusting the width of the single horizontal extension for various size chairs 100, and the opposite slots for a friction-fit to the seatback frame without fastening. The single horizontal extension is appropriately attached along the length of the vertical arms. In this embodiment, there is a preferred distance of between about 8 inches to about 21 inches, preferably about 8¼ inches, between the top of the chair and the single horizontal extension.

Figure 2:
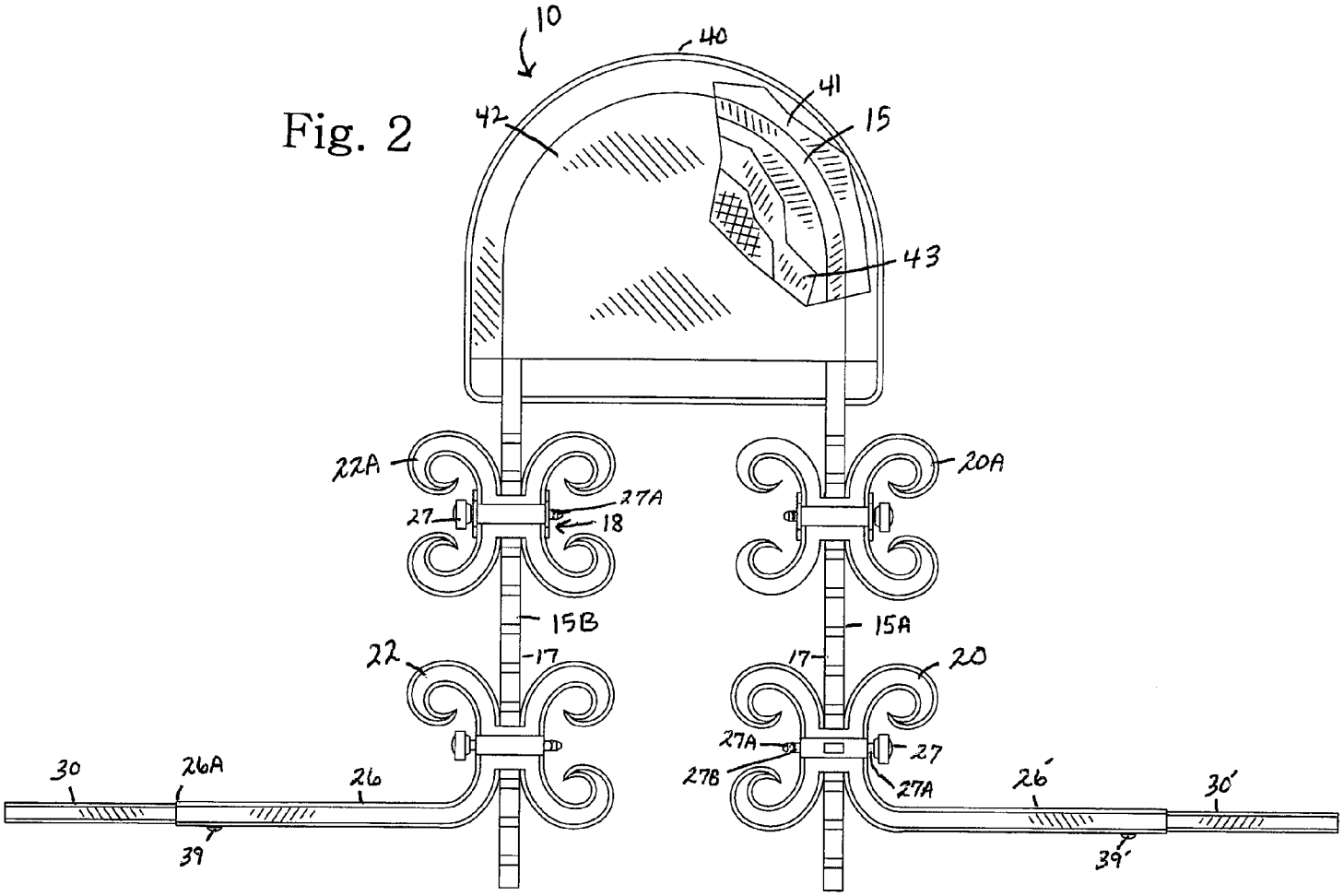
FIG. 2 is a rear view of the present invention with a cutaway in the headrest portion.

The headrest 10 further includes a cushioned member 40 having a U-shaped configuration similar to the upper portion 16 of the headrest support bar 15. The cushion member includes a pocket 41 sized for receiving the upper portion 16 of the support bar 15 as shown in FIG. 2, and further including an exterior surface 42 and interior foam layer 43, the foam layer 43 sandwiched between the exterior 42 and the pocket 41.

The cushioned member 40 can be readily attached by friction-fit or otherwise to the headrest support bar 15, regardless of whether with a folding lawn chair, deck chair or other lightweight, portable seating, and can be readily adjusted for the height of the user's head by utilizing the adjusting means of the headrest support bar 15 and first and second lower rosettes 20, 22.

To adjust the height of the headrest 10, the vertical arms 15A, 15B are vertically urged through the clamp member 18 in an upwardly and downwardly direction in order to position the upper portion 16. Once the upper portion 16 (with the cushion member 40) of the support bar 15 is properly positioned for the user, the vertical arms are slightly urged once again in either an upward or downward direction until the pin member 27 received in the horizontal bore 25 of the clamp member 18 is received within a horizontal furrow 24 of the horizontal arm. Once the pin member is accepted in the horizontal furrow 24, tightening the pin member 27 that is now disposed within both the horizontal bore 25 and the selected horizontal furrow 24, with fastener 27B secures each lower rosette to each vertical arm.

The upper rosettes 20A, 22A, include identical clamp members 18 as the lower rosettes 20, 22, and are configured to attach to the vertical arms similar to the lower rosettes 20, 22 described above.

The upper rosettes 20A, 22A, can further include a lip 23 that defines a slot 23A that can be positioned to releasably receive the top 105 of the chair 100.

In the preferred embodiment, the cushion member 40 includes the foam layer 43, which is preferably a foam rubber material, covered by the exterior 42, which is preferably a vinyl sheet and secured by any means to the upper portion 16 of the headrest support bar 15 having the same planar area.

The cushion member 40 may be formed using any of a number of materials and methods, but is preferably formed as a single, unitary component of semi-rigid plastic material. It will be noted that both good structural strength and compliance to the form of the person using the present headrest 10 may be achieved using such material.

Although the above description contains many specificities, these should not be construed as limiting the scope of the invention but is merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus, the scope of the invention should be determined by the appended claims in the formal application and their legal equivalents, whether than by the examples given.

I claim:

1. An adjustable height headrest device for a casual seating comprising:

a U-shaped frame having an upper portion, a first vertical arm, and a second vertical arm, first and second horizontal members that define a longitudinal axis, clamping means for selectively securing the first horizontal member to the first vertical arm and the second horizontal member to the second vertical arm, wherein said first and second horizontal members are aligned and wherein said first horizontal member extends in a first direction from said U-shaped frame and said second horizontal member extends in a second, opposite direction from said U-shaped frame, and wherein there is a spacing between a top end of the casual seating and the first and second horizontal members, wherein the first and second horizontal members each include a telescoping extension and a distal end, a perpendicularly extending first portion, and a second portion extending perpendicular from the first portion and parallel to said distal end along said longitudinal axis defining a hook member sized for receiving a frame member of the casual seating, and a cushioned member having a pocket sized for receiving the upper portion of the U-shaped frame.

2. The headrest as recited in claim 1, wherein said U-shaped frame having a plurality of furrows, and wherein said clamping means includes a bore selectively aligning said bore with one of said plurality of furrows, wherein said aligned bore and furrow for receiving a fastener.

3. The headrest device as recited in claim 2, wherein the first horizontal member is selectively secured in alignment with one of the plurality of furrows along the length of the first vertical arm, and wherein the second horizontal member is selectively secured in alignment with one of the plurality of furrows along the length of the second vertical arm.

4. The headrest as recited in claim 3, wherein the plurality of furrows are disposed on a rear surface of said U-shaped frame.

5. The headrest device as recited in claim 1, wherein said spacing is between 8-21 inches.

6. The headrest device as recited in claim 5, further including a first ornament attached to the first vertical arm, and a second ornament attached to the second vertical arm.

7. The headrest device as recited in claim 6, wherein each of said first and second ornaments include a lip that defines a slot sized to receive the top end of the casual seating.

8. An adjustable height headrest device for a casual seating comprising:

a U-shaped frame having an upper portion, a first vertical arm, and a second vertical arm, wherein each of said first and second vertical arms include at least one furrow, a first horizontal member including a first clamp member for selectively securing the first horizontal member to the first vertical arm, and a second horizontal member including a second clamp member for selectively securing the second horizontal member to the second vertical arm, wherein said first and second clamp members each, include a bore that aligns with said furrow, wherein said aligned bore and furrow for receiving a fastener means, wherein said first and second horizontal members are aligned and wherein said first horizontal member extends in a first direction from said U-shaped frame and said second horizontal member extends in a second, opposite direction from said U-shaped frame such that said first and second horizontal members define a longitudinal axis, wherein first and second horizontal members each include a telescoping extension having a distal end, a perpendicularly extending first portion, and a second portion extending perpendicular from the first portion and parallel to said distal end along said longitudinal axis that defines a hook member for receiving a frame member of the casual seating, and a cushioned member having a pocket sized for receiving the upper portion of the U-shaped frame.

9. The headrest device as recited in claim 8, wherein a spacing is defined between a top end of the casual seating and the first and second horizontal members.

10. The headrest device as recited in claim 9, wherein said spacing is approximately 8¼ inches.

11. The headrest device as recited in claim 10, further including a first ornament attached to the first vertical arm, and a second ornament attached to the second vertical arm.

12. The headrest device as recited in claim 11, wherein each of said first and second ornaments include a lip that defines a slot sized to receive the top end of the casual seating.

13. The headrest device as recited in claim 12, wherein the first horizontal member is selectively secured in alignment with the furrow along the length of the first vertical arm, and wherein the second horizontal member is selectively secured in alignment with the furrow along the length of the second vertical arm.

14. The headrest as recited in claim 13, wherein the furrows are disposed on a rear surface of said U-shaped frame.

15. An adjustable height headrest device for a casual seating comprising:

an upper portion having a U-shaped configuration, and a lower portion, a horizontal member, clamping means for selectively securing the horizontal member to the lower portion, wherein said horizontal member is perpendicular to said lower portion, and wherein a spacing disposed between a top end of the casual seating and the horizontal member, and wherein said horizontal member includes first and second hook members disposed on opposite ends for receiving a frame member of the casual seating, and a cushion member having a pocket sized for receiving the upper portion, said horizontal member includes a telescoping extension, and wherein said lower portion comprising first and second vertical arms, and further including a first ornament attached to the first vertical arm, and a second ornament attached to the second vertical arm, and wherein each of said first and second ornaments include a lip that defines a slot sized to receive the top end.

16. The headrest device as recited in claim 15, wherein said horizontal member includes a clamp having a bore, and wherein said lower portion includes a plurality of furrows, and wherein selectively aligning said bore with one of said plurality of furrows and receiving a fastener means within said aligned bore and furrow secures the horizontal member to the first and second vertical arms.

* * * * *